US005429173A

United States Patent [19]

Wang et al.

[11] Patent Number: 5,429,173

[45] Date of Patent: Jul. 4, 1995

[54] METALLURGICAL BONDING OF METALS AND/OR CERAMICS

[75] Inventors: Yucong Wang; Dennis M. Meyers; Paul H. Mikkola, all of Saginaw, Mich.

[73] Assignee: General Motors Corporation, Detroit, Mich.

[21] Appl. No.: 169,123

[22] Filed: Dec. 20, 1993

[51] Int. Cl.[6] ..... B22D 19/00

[52] U.S. Cl. ..... 164/75; 164/100

[58] Field of Search ..... 164/75, 100, 91; 29/527.3

[56] References Cited

U.S. PATENT DOCUMENTS

| | | | |
|---|---|---|---|
| 2,544,670 | 3/1951 | Grange et al. . | |
| 3,069,209 | 12/1962 | Bauer | 309/3 |
| 3,165,983 | 1/1965 | Thomas | 92/169 |
| 3,276,082 | 10/1966 | Thomas . | |
| 3,480,465 | 11/1969 | Imabayashi et al. . | |
| 4,997,024 | 3/1991 | Cole et al. | 164/75 |
| 5,179,994 | 1/1993 | Kuhn | 164/100 |
| 5,293,923 | 3/1994 | Alabi | 164/100 X |

FOREIGN PATENT DOCUMENTS

| | | | |
|---|---|---|---|
| 60-216969 | 10/1985 | Japan | 164/75 |
| 63-242459 | 10/1988 | Japan | 164/100 |
| 1-166876 | 6/1989 | Japan | 164/100 |
| 1-233055 | 9/1989 | Japan | 164/100 |

OTHER PUBLICATIONS

Definition "Thermite", Encyclopedia Americana V. 26 (1976) p. 645.

Abstract-"Thermite aluminium for rapid and rational cable connections", Author, Zuliani-Journal:Elettrificazione No. 5 pp. 206-210 (May 1978)-Country, Italy.

Abstract-"Bonding of Sintered Alumina and Metals with Thermal Spray Coatings ", Author(s), Kamota et al.-ASM International (USA) 1992 pp. 929-934-Journal #9212.

Abstract-"Ni-Al Re-Evaluated", Author(s), Sampath et al-ASM International (USA) 1988, pp.47-53, Journal #9104.

Abstract-"Joining of Aluminum Conductors Using MgFeO Thermit Cartridge", Author, Vukelic-Zavarivanje (Zagreb) v.27 n.2 Mar-Apr 1984, pp.169-17-6-Journal #8609.

Abstract of Japanese Patent Publication 55-10369 published Jan. 24, 1980.

*Primary Examiner*—J. Reed Batten, Jr.

*Attorney, Agent, or Firm*—Lawrence B. Plant

[57] ABSTRACT

A solid material is bonded to a metal cast thereagainst by means of a metallurgical diffusion bond. The solid material is coated with a latent exoergic coating which coating reacts exothermically to produce intermetallic phases at the surface of the solid when the metal is cast thereagainst. The heat generated by the intermetallic-phase-formation reaction promotes the diffusion bond.

17 Claims, 2 Drawing Sheets

METALLURGICAL BONDING OF METALS AND/OR CERAMICS

This invention relates to the bonding of a cast metal to a solid metal or ceramic insert and the resulting product. More specifically, it is concerned with providing a metallurgical diffusion bond between a metal or ceramic insert and a metal cast thereagainst.

BACKGROUND OF THE INVENTION

The automotive industry, inter alia, is moving toward the use of more and more lightweight metals in order to reduce vehicle weight, improve fuel economy, and improve heat transfer in certain components (e.g., brake drums, engines, etc.).

Brake drums were originally constructed 100% of iron or steel for strength, wear and friction reasons. Subsequently, composite brake drums were used wherein a cast iron or steel liner provided the friction surface and was backed up with an aluminum backing cast thereabout for reducing the weight and improving the heat dissipation of the brake drum. Similarly, some internal combustion (IC) engines have used iron/steel cylinder liners insert molded into cast aluminum blocks. The aluminum reduces the vehicle weight and improves engine cooling.

The production of such composite castings with effective bonding between the insert (e.g., brake or engine liners) and the aluminum cast thereabout has been a continuing problem for many years. Mechanical bonding techniques have been used, but due to the differences in thermal expansion between the insert and the cast metal have encountered some difficulties. Hence in the case of Fe liners cast into aluminum, the aluminum tends to expand away, and separate from, the iron insert resulting in poor and often nonuniform heat transfer. The use of low melting metal coatings (e.g., zinc and its alloys) on the insert prior to casting the metal thereagainst has achieved some success, but even this technique is not free from problems.

Accordingly, it is the principal object of the present invention to simply produce a unique permanent, metallurgical bond between a solid metal or ceramic insert and metal cast thereagainst via an intermediate intermetallic layer formed in situ during casting, the constituents of which diffuse into both the insert and the cast metal to produce a bond which resists separation of the cast metal from the insert even at elevated temperatures typically achieved in brake drums and IC engines. This and other objects and advantages of the present invention will become more readily apparent from the detailed description thereof which follows.

BRIEF DESCRIPTION OF THE INVENTION

Broadly, the present invention relates to a method for casting a metal against a solid metal or ceramic insert which insert has a latent exoergic coating thereon for producing a tenacious bond at the interface between the insert and coating, and the interface between the cast metal and the coating at the time the metal is cast about the insert incident to the in situ exothermic formation of intermetallic phases in the zone between the solid metal and the cast metal. While certain "metals" are specified herein it is not intended that the term "metal" be limited to the pure metal itself, but the term "metal" is intended to include mixtures and alloys thereof. Hence, when the term "iron" is used it includes iron-based alloys, steel and the like. The invention is applicable to all conventional casting methods including gravity, countergravity and pressure (e.g., die casting or squeeze casting) casting techniques. More specifically, the invention contemplates casting a low melting point metal against the surface of a solid, high melting point material (i.e., metal, intermetallic, ceramic, etc.) so as to intimately bond the cast metal to the solid material via a metallurgical bond. The temperature at which the metal is cast is above the melting point of the cast metal, but below the melting point of the solid material. While the casting metal will preferably comprise aluminum or magnesium, the invention is not limited thereto, but is applicable to other metals (e.g., zinc, copper and iron) provided that its melting point is lower than that of the solid insert against which it is cast. According to the invention a latent exoergic coating is first deposited onto the surface of the solid insert material to be bonded to the cast metal. The latent exoergic coating comprises at least two dissimilar elements capable of reacting exothermically at the casting temperature of the cast metal to produce intermetallic phase at the interfacial zone between the solid insert and the cast metal. When the molten metal contacts the exoergic coating during casting, the exothermic intermetallic-phase-forming reaction is initiated, and, in turn, generates sufficient heat at the insert's surface to diffuse the unreacted elements and the atomic constituents of the intermetallic phases produced into both the solid insert material and the molten metal such that upon cooling a permanent metallurgical bond is formed therebetween. Substantial diffusion of the intermetallics' constituent atoms is observed in the cast metal and in the metal inserts. Lesser diffusion is noted in the ceramic inserts.

The latent exoergic coating will preferably be deposited by thermospraying the dissimilar elements onto the solid material. "Thermospraying" refers to a group of processes wherein finely divided surfacing materials are propelled from a nozzle, in a molten or semi-molten condition, and deposited onto a suitably prepared (e.g., cleaned and/or roughened) substrate. The term "thermospraying" includes such specific processes as "arc-spraying", flame-spraying and plasma-spraying all of which are well known in the art and applicable to the present invention. The elemental material to be deposited will be in the form of powder, rod, cord or wire which is fed into an appropriate thermospraying device. The thermospraying device generates the heat required to melt the elements by means of combustible gases, ionized gas or an electric arc, depending on which form of thermospraying is utilized. An inert gas arc-spray process is preferred over the other thermospray methods, because of the lower tendency for the coating to oxidize during thermospraying and lower operating costs. As the coating elements are heated in the spraying device, they change to a plastic or molten state, and are propelled by compressed inert gas through a spray nozzle onto the target surface of the solid insert. The particles strike the target surface, flatten, and form thin overlapping platelets that conform and adhere to the irregularities of the target surface and to each other. When the molten particles impinge upon the substrate, they build up particle-by-particle into a lamellar structure. The target surface is preferably cleaned and roughened (e.g., as by sand blasting) prior to depositing the latent exoergic coating. Preferably, the elements comprising the latent exothermic coating will be codeposited from a single spray nozzle simultaneously fed by the elements forming the coating. However, separate spray devices may be used for spraying each element separately. The elements comprising the ingredients for making up the intermetallic phases formed during the casting operation are deposited on the surface of the target's solid material in substantially unreacted, elemental form. In this regard, the thermospraying process is so rapid that the metal particles emanating from the spraying nozzle, and impinging on the target, move so quickly, and are quenched so rapidly, that substantially no intermetallic phase is formed at that time. Thereafter when the coated solid material is contacted by the molten metal cast thereagainst, the heat from the molten metal triggers the intermetallic-phase-formation reaction which, in turn, generates substantial quantities of heat at the target surface of the solid material. The heat promotes the diffusion of the materials comprising the coating into both the solid material on one side thereof and the cast material on the other side thereof.

The dissimilar elements forming the latent exoergic coating are selected from the group consisting of metals and silicon which react to form intermetallic phases at the temperature of the metal cast thereagainst. Such metals as aluminum, and copper, nickel or titanium are preferred because of their ability to produce intermetallics at relatively low temperatures, and their ability to diffuse into and alloy with many materials without difficulty or adverse results. The solid insert material onto which the latent exoergic coating is deposited is preferably selected from the group consisting of iron, copper, titanium, nickel, intermetallics and ceramics. The metal cast about the insert is preferably selected from the group consisting of aluminum, magnesium, copper and iron provided that the specific combination of materials insures that the solid insert material has a higher melting point than the metal cast thereagainst. Among the solid intermetallics useful as an insert and onto which the exoergic coating is deposited are nickel aluminide, titanium aluminide and iron aluminide. The particular combination of materials chosen is, of course, a function of the nature of the product sought to be made (e.g., brake drum, IC engine, aerospace vehicle component, etc.), the relative melting points of the materials, and the composition of the exoergic coating needed to effect bonding. Preferably, one of the dissimilar elements forming the exoergic coating will correspond to the metal being cast in order to achieve optimum diffusion into that metal during casting and cooling. Hence, if aluminum is the cast metal, one of the exoergic coating elements will also comprise aluminum and the resulting intermetallic will be aluminides. While the dissimilar elements are preferably simultaneously co-deposited onto the target solid material as droplets, they may alternatively be deposited in multiple, alternating, very thin (i.e., ca. 0.001–0.002 inches) layers with about 5 to about 20 such layers being required. The first such layer will preferably comprise the element corresponding to the metal being cast, e.g., aluminum.

It may be desirable, in some instances, to coat the exoergic layer itself with a layer of a low melting point alloy to enhance the bonding strength at the interface between the exoergic coating and the cast metal. For example, when aluminum is the cast metal, low melting point alloys used to cover the exoergic coating include zinc-aluminum alloys, aluminum-magnesium alloys, aluminum-tin alloys, and multi-component systems such as aluminum-zinc-tin and aluminum-magnesium-silicon. Either pre-alloyed or mechanical mixtures thereof are sprayed directly over the exoergic coating.

In some instances, it may be desirable to provide two separate and distinct exoergic coatings, the temperatures at which their respective intermetallic-phase-formation reactions commence being different. In this regard, it may be desirable to have a first exoergic reaction occur at the temperature of the molten metal being cast, which first reaction then initiates the intermetallic-phase-formation reaction of the second coating at a higher temperature made possible by the first reaction.

After the exoergic coating is deposited onto the solid target material, the coated material is positioned in an appropriate mold, and the metal cast thereagainst. The selection of dissimilar elements in the coating is such as to insure that the latent exoergic coating will react exothermically to form intermetallic phases at the casting temperature of the metal being cast. In this regard, intermetallics such as copper-aluminide, nickel-aluminide, titanium-aluminide and nickel-silicide are preferred. Once their formation reaction is initiated, such intermetallics can release a significant amount of heat at the interface between the insert and the cast metal to promote the formation of a permanent metallurgical diffusion bond between the coating, the insert and the cast metal.

In a most preferred embodiment of the invention, the solid material comprises iron, the metal cast thereagainst comprises aluminum, one of the dissimilar elements in the latent exoergic coating is aluminum and the other element is copper. A particular application of this combination is found in an IC engine wherein the iron forms the cylinder liner and the aluminum cast thereagainst forms the remainder of the engine block. In such embodiment, the intermetallic phases which are formed at the time the aluminum is cast and which promote the bonding of the iron insert and the cast aluminum comprise copper-aluminides.

The dissimilar elements making up the latent exoergic coating will typically form different phases of the intermetallic. Hence, for example, in the case of the preferred aluminum-copper intermetallic system, three distinct phases, i.e., the $\theta$ phase ($Al_2Cu$), the $\eta_2$ phase ($AlCu$) and the $\delta$ phase ($Al_2Cu_2$) are in evidence. The formation of each of these intermetallics gives off somewhat different heats of reaction. In this regard, the formation of the $\theta$ phase gives off about 13,050 joules per mole, the $\eta_2$ phase gives off about 19,920 joules per mole and the $\delta$ phase gives off about 20,670 joules per mole. While it is possible to bias the formation toward certain of the phases by depositing different concentrations of the dissimilar elements in the exoergic coating in proportion to the concentration of that element in the particular phases sought, as a practical matter it is unnecessary to do so as sufficient heat is generated by the formation of a mixture of the phases from a coating composition comprising simply 50 atomic percent of one of the dissimilar elements and 50 atomic percent of the other. It should be noted, at this point, that while the invention is being described primarily in terms of two ingredient intermetallics, ternary, quaternary, etc., metal systems may also be used so long as (1) they react exothermically at the temperature of the casting metal to form intermetallics at the interface between the casting metal and the solid material or (2) can be made to so react by heat produced from a first exoergic coating whose reaction is initiated during casting. Moreover, other alloyants may be included in the sprayed material to modify the physical properties of the sprayed coating. Hence for example, if it were desired to produce a tough (i.e., not brittle) intermetallic Al—Ni intermediate zone, an element such as boron might be added to the composition forming the exoergic coating. Finally, it is important to note that not 100% of the dissimilar metals need react to form the intermetallics. In this regard, it is quite common to have some residual concentration of unreacted elements remain in the zone between the cast metal and the solid material, which residual elements diffuse into the solid material and the molten material at the same time as the constituents making up the intermetallics diffuse therein. Preferably, the reaction will be at least about 80% complete.

When aluminum is used as the metal being cast against the solid insert material, the exoergic coating should include aluminum as one of the reacting elements. In this regard, only aluminum-based coatings will react to produce intermetallics at the temperatures normally used for aluminum casting. Hence for example, (1) aluminum-copper intermetallics are formed from copper and aluminum at about 550° C., (2) aluminum-nickel intermetallics are formed from nickel and aluminum at about 700° C. and (3) aluminum-titanium intermetallics are formed from titanium and aluminum at about 700° C. Because of its low reaction triggering temperature, the aluminum-copper system is the most preferred when casting aluminum. The Al—Ni and Al—Ti systems require more heat in the system to initiate and sustain the reaction than does the Al—Cu system. It is also advantageous to have the latent exoergic coating contain aluminum for improved diffusion of the intermetallic and its ingredients into the aluminum as discussed above. One of the particular advantages of the present invention is that while the solid insert (e.g., cylinder liner) may be preheated prior to casting the metal thereagainst it need not be so since sufficient heat is generated by the exothermic reaction to promote bonding without this additional step.

The invention is useful with a variety of different combinations of materials for various applications. Thus iron, copper, titanium, metal matrix composites (MMC), intermetallics or ceramics may have Al, Mg or Zn cast thereagainst using exoergic coatings forming Al—Cu, Al—Ni, Al—Ti intermetallics. Likewise iron, MMCs, titanium, intermetallics or ceramics may have copper cast thereagainst using exoergic coatings forming Al—Cu, Al—Ni, Al—Ti, Ni—Si and other aluminides and silicides with suitable formation temperatures. These latter coatings are likewise believed to be effective for solid steel, intermetallic, MMC or ceramic inserts having iron cast thereagainst. Finally, solid Ni inserts having copper or aluminum cast thereagainst using the Cu or Ni aluminides are seen to be effective.

The invention further contemplates an article of manufacture (e.g., an IC engine, a brake drum, etc.) comprising a first material having a relatively high melting point, a metal bonded to the first material which metal has a melting point less than the first material, and a zone intermediate the first material and the cast metal containing intermetallic phases formed in situ on the surface of the first material during casting. The intermetallic phase intermediate the solid material and the cast metal bonds the solid material to the cast metal and forms a joint wherein the center of the intermediate zone is rich in the intermetallic phases and any unreacted elements from the exoergic coating. The concentration of the constituents of the intermetallics and the unreacted elements gets progressively more dilute in regions of the intermediate zone more remote from the center as a result of diffusion of the constituents, and the elements away from the center into the solid material and the cast metal during the casting and solidification of the metal.

BRIEF DESCRIPTION OF THE DRAWINGS

The invention will better be understood when considered in the light of the following description of a detailed example thereof which is given hereafter in conjunction with the several figures in which.

DETAILED DESCRIPTION OF A PREFERRED EMBODIMENT

Figure 1:
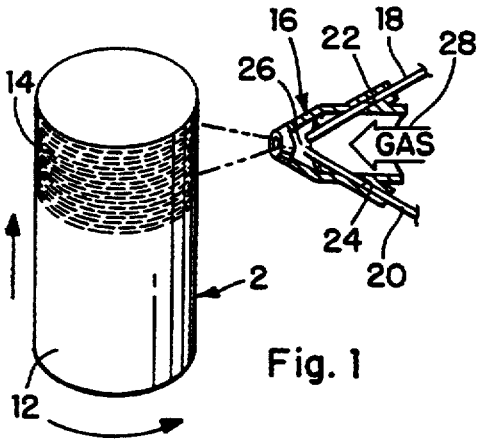
FIG. 1 illustrates spray coating of a cylinder liner for an internal combustion engine with the latent exoergic coating of the present invention.

FIG. 1 illustrates an iron cylinder 2 lining the combustion chamber 4 of an internal combustion engine block 6 which is cast from aluminum 8 about the liner 2 in an engine block mold (not shown). Appropriate expendable or removable cores (not shown) are utilized during casting to form the cooling jacket 10. The block 6 will preferably be formed by conventional gravity sand casting techniques which are well known in the art and not a part of the present invention.

The surface 12 of the cylinder 2 is preferably cleaned and roughened (e.g., as by sandblasting) before it is coated with a latent exoergic coating 14 according to the present invention. As illustrated, the exoergic coating 14 is thermosprayed onto the surface 12 from a nozzle 16 of an arc-spraying device. FIG. 1 illustrates the preferred embodiment in which the elements comprising the exoergic coating are co-sprayed from a single nozzle 16. However, separate nozzles for each of the elements may also be used in a manner which either simultaneously propels both elements onto the surface 12 or, in the alternative, by a plurality of alternating layers of each element as described above. The objective is to have the reacting elements in a fine distribution and intimate contact with each other in order to effect an efficient intermetallic phase reaction. In the embodiment illustrated, the solitary thermospraying nozzle 16 is of the electric-arc spray type, and copper rod/wire 18 and aluminum rod/wire 20 are concurrently fed into the nozzle 16 through openings 22 and 24 in the sides thereof at rates which provide a 50-50 mixture of Cu and Al in the exoergic coating. An electric arc 26 is struck between the copper and aluminum feed stock so as to form molten droplets of aluminum and copper. Pressurized inert gas (e.g., argon) 28 propels the molten droplets out the end of the nozzle 16 and impinges them on the surface 12 of the insert 2 where they are instantaneously quenched and solidified before any significant intermetallic-forming reaction can occur. Alternatively, a plasma thermospray nozzle may be used. When plasma spraying is used powdered copper and aluminum are preferably fed into the nozzle wherein hot ionized gas melts and propels the droplets against the surface 12.

After the cylinder 2 has been coated with the latent exothermic coating 14, it is positioned in an appropriate mold and molten aluminum 8 cast thereabout. The heat from the molten aluminum triggers the exothermic reaction of the elements in the latent exoergic coating 14 in the formation of the intermetallic phases corresponding to the elements present. The reaction creates a zone 11 intermediate the iron liner 2 and the cast aluminum 8. The intermediate zone 11 is richest in the intermetallic and unreacted elements at its center and more dilute with respect thereto more remote from the center as the intermetallics and the unreacted elements diffuse into the liner and the cast aluminum on either side of the coating.

Figure 3:
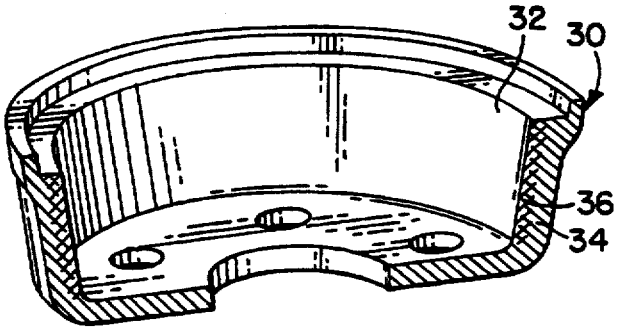
FIG. 3 is a sectioned, perspective view of a brake drum made in accordance with the present invention.
Figure 2:
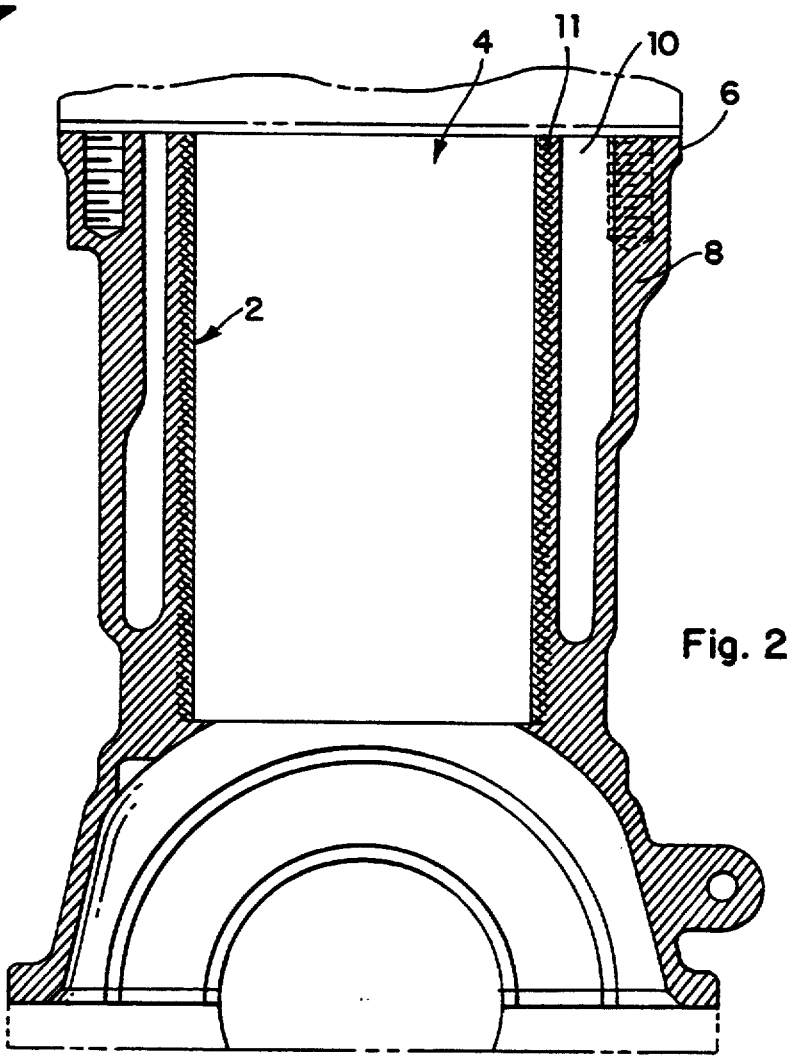
FIG. 2 is a side, sectional view through an internal combustion engine block made in accordance with the present invention.

FIG. 3 illustrates a brake drum 30 comprising an iron liner 32, an aluminum shell 34 cast thereabout, and an intermediate, intermetallic-rich zone 36 comparable to the zone 11 of FIG. 2.

SPECIFIC EXAMPLE

A Cu—Al latent exoergic coating was deposited onto the outside diameter of a low carbon steel IC engine cylinder liner by a plasma thermospray process using argon as the propellant gas. The liners were grit blasted before coating. Individual hoppers of powdered Al and Cu were used to supply the respective metals to the nozzle of the plasma spray device. The two component coatings were sprayed in alternate layers starting with the aluminum layer until a total of 11 layers of aluminum and 10 layers of copper were deposited onto the liner. Each layer had an individual thickness of about 0.001–0.002 inches. The coated liners were placed in a green sand mold and aluminum alloy 319 cast thereabout at a pouring temperature of 1450° F. Just prior to casting, the mold and liner were preheated at a temperature of 200° F. for a sufficient period of time to remove any moisture therefrom. The exoergic coating promoted the formation of a permanent metallurgical bond between the liner and the 319 Al.

Figure 4:
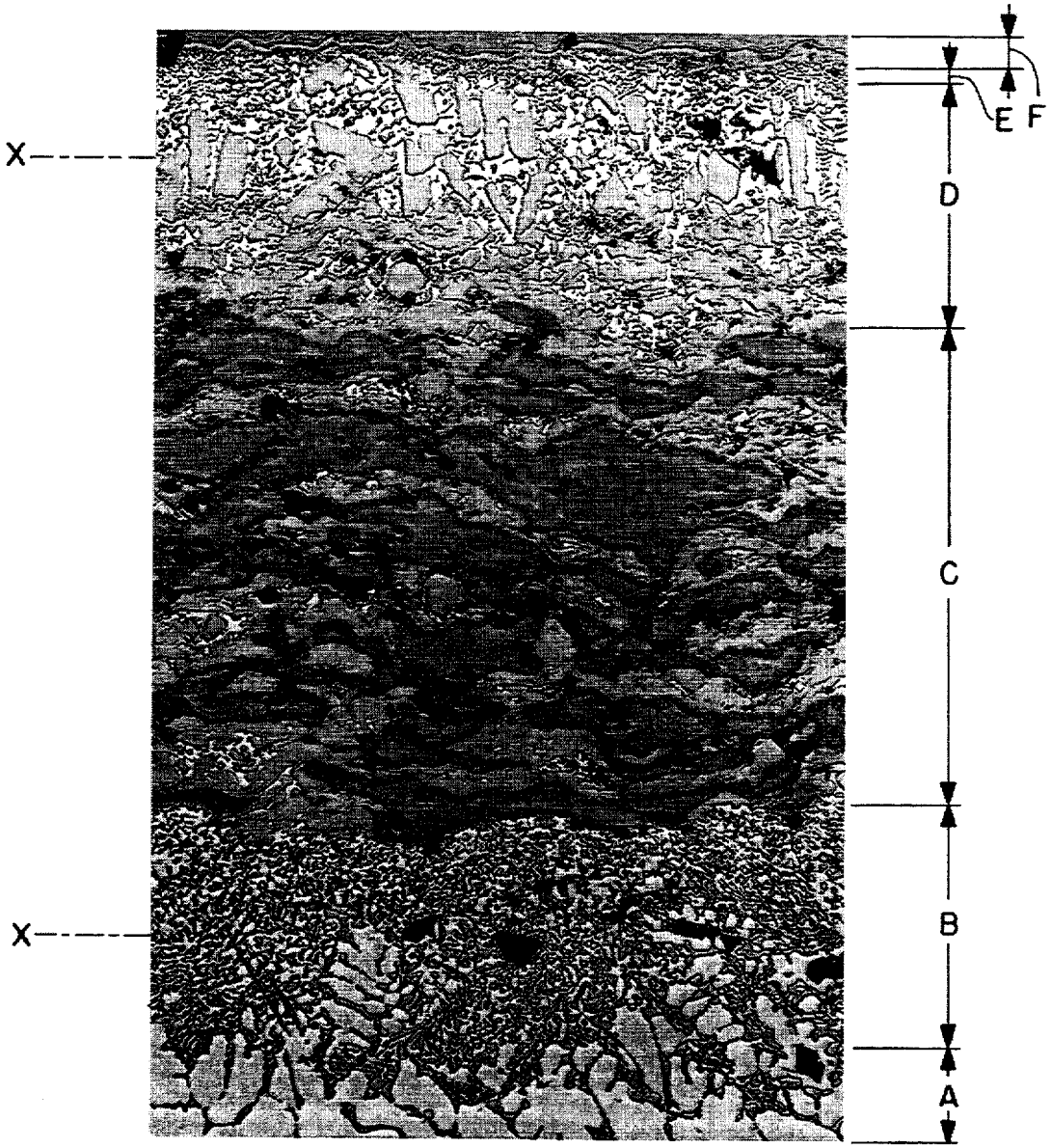
FIG. 4 is a photomicrograph of an aluminum engine block casting bonded to an iron cylinder liner made according to the present invention.

Tests conducted on the thusly prepared cylinder liners indicated that a small, insignificant amount of the Cu and Al reacted during the thermospray process. The bulk of the intermetallic-formation reaction did not occur until the aluminum was cast about the liner. FIG. 4 is a photomicrograph of a portion of the casting taken through the intermediate zone between the iron liner and the aluminum casting. About 95 percent of the Cu and Al reacted to form at least three intermediate Cu—Al phases in the coating. These phases were identified by electron micro-probe analysis as being the $\theta$ phase, the $\eta_2$ phase, and the $\delta$ phase. Strong exothermic reactions occurred in forming these intermediate phases and the heat released thereby increased the temperature at the surface of the liner and promoted diffusion of the intermetallics' constituents and the unreacted coating elements into the liner (see FIG. 4 regions D and E) and the cast aluminum (see FIG. 4 area B). Besides the formation of the intermediate phases in the coating, new phases formed in the diffusion regions adjacent the coating, i.e., where the coating and the liner, and the coating and the aluminum, meet. Microprobe analysis at various sites in the several regions of the intermediate zone between the liner and the aluminum showed the existence of a variety of phases. In this regard, the composition of each of the phases identified in each of the regions A–F shown in FIG. 4 are given in the following table. The lines marked X and X on FIG. 4 show where the boundaries of the original exoergic coating prior to casting the metal and before diffusion of its ingredients into the surrounding materials.

TABLE

| | | (1)Atomic % Composition | | | | |
|---|---|---|---|---|---|---|
| Region | Site | Si | Al | Cu | Fe | Wt. % Sum |
| A | 1 | 1.1 | 97.8 | 1.1 | <0.1 | 101.1 |
| | 2 | 97.1 | 2.4 | 0.4 | 0.1 | 102.1 |
| | 3 | 1.0 | 67.3 | 31.4 | 0.4 | 99.7 |
| | 4 | 2.1 | 66.0 | 31.5 | 0.5 | 100.8 |
| B | 1 | 98.9 | 0.1 | 1.0 | <0.1 | 101.4 |
| | 2 | 0.4 | 97.9 | 1.7 | <0.1 | 101.1 |
| | 3 | 1.0 | 66.1 | 32.9 | <0.1 | 100.6 |
| | 4 | 0.9 | 68.0 | 31.3 | <0.1 | 101.9 |
| C | 1 | 0.2 | 98.2 | 1.6 | <0.1 | 102.4 |
| | 2 | 0.3 | 67.3 | 32.4 | 0.1 | 102.5 |
| | 3 | 0.1 | 50.4 | 49.4 | <0.1 | 101.2 |
| | 4 | 0.1 | 39.8 | 60.1 | <0.1 | 100.5 |
| | 5 | 0.2 | 0.3 | 99.5 | <0.1 | 100.2 |
| D | 1 | 0.6 | 97.2 | 2.3 | <0.1 | 100.7 |
| | 2 | 83.1 | 16.1 | 0.8 | <0.1 | 108.7 |
| | 3 | 0.9 | 66.8 | 32.2 | <0.1 | 100.0 |
| | 4 | 0.7 | 67.5 | 31.7 | 0.2 | 100.3 |
| E | 1 | 0.7 | 69.6 | 19.8 | 9.9 | 99.5 |
| | 2 | 7.5 | 68.9 | 3.5 | 20.1 | 100.5 |
| | 3 | 2.6 | 69.7 | 1.3 | 26.4 | 100.1 |
| F | 1 | <0.1 | <0.1 | 0.2 | >99 | (also ~0.5% Mn) |

(1)Values are estimated accurate to +/−5% relative and normalized to 100%

Similar tests were run using Ni—Al coating. No reaction between the nickel and aluminum was observed in the as-sprayed coating. After casting, Ni—Al intermediate phases were observed. The exothermic reaction was not as great as that of the Cu—Al system, and only about 3 percent by volume of the intermetallic, was observed. Higher yields (i.e., about 20%) of the Ni—Al intermetallic were observed when a Cu—Al exoergic coating was deposited atop the Ni—Al coating. The Cu—Al reaction triggered the nickel-aluminum reaction and provided additional heat for the Ni—Al reaction. Still higher yields can be expected by using higher melt temperatures and preheating the inserts to higher temperatures.

While the invention has been disclosed primarily in terms of specific embodiments thereof, it is not intended to be limited thereto but rather only to the extent set forth thereafter in the claims which follow.

The embodiments of the invention in which an exclusive property or privilege is claimed are defined as follows:

1. A method of bonding a surface of a solid material to a metal cast thereagainst at a temperature above said metal's melting point and below said material's melting point comprising the steps of:

depositing a latent exoergic coating onto said surface, said coating comprising at least two dissimilar elements capable of reacting at said casting temperature to exothermically produce intermetallic phases of said elements at said surface; and casting said metal against said surface at said temperature so as to initiate said exothermic reaction and locally generate sufficient heat at said surface to diffuse phases into said material and said metal and form a metallurgical bond therebetween.

2. A method according to claim 1 including the step of thermospraying said dissimilar elements onto said surface.

3. A method according to claim 2 wherein said dissimilar elements are concurrently sprayed onto said surface from a single spray nozzle.

4. A method according to claim 3 wherein said thermospraying is effected by plasma spraying.

5. A method according to claim 3 wherein said thermospraying is effected by arc spraying.

6. A method according to claim 1 wherein said dissimilar elements are selected from the group consisting of metals and silicon.

7. A method according to claim 6 wherein said metals in said exoergic coating are selected from the group consisting of aluminum, copper, nickel, and titanium.

8. A method according to claim 1 wherein said material is selected from the group consisting of iron, copper, titanium, nickel intermetallics and ceramics, and said metal cast thereagainst is selected from the group consisting of aluminum, magnesium, copper and iron.

9. A method according to claim 1 wherein one of said dissimilar elements comprises said metal.

10. A method according to claim 8 wherein said solid intermetallic material is selected from the group consisting of nickel-aluminide, titanium aluminide, and iron aluminide.

11. A method according to claim 1 wherein said dissimilar elements are alternately deposited in layers onto said surface.

12. A method according to claim 1 wherein said intermetallic phases formed by said exothermic reaction are selected from the group consisting of copper aluminides, nickel aluminides, titanium aluminides, and nickel silicides.

13. A method according to claim 1 wherein said solid material comprises iron, said metal cast thereagainst comprises aluminum, one of said dissimilar elements comprises aluminum, another of said dissimilar elements is selected from the group consisting of nickel, copper and titanium, and said intermetallic phases comprise aluminides.

14. A method according to claim 13 wherein said another dissimilar element is copper and said intermetallics are copper aluminides.

15. A method according to claim 1 wherein a second coating is deposited atop said exoergic coating, said second coating comprising a metal having a melting point lower than said cast metal.

16. A method according to claim 15 wherein said cast metal is aluminum and said second coating is selected from the group consisting of zinc-aluminum alloys, aluminum-magnesium alloys, aluminum-tin alloys, aluminum-zinc-tin alloys and aluminum-magnesium-silicon alloys.

17. A method according to claim 1 wherein a second latent exoergic coating is deposited atop said latent exoergic coating, the second exoergic coating requiring a different temperature to initiate the intermetallic-phase-formation reaction than said latent exoergic coating and the heat of reaction from said latent exoergic coating's reaction initiates the reaction of the second latent exoergic coating.

* * * * *